US005964373A

United States Patent [19]

Hucknall

[11] Patent Number: 5,964,373

[45] Date of Patent: Oct. 12, 1999

[54] DISPENSER APPARATUS

[75] Inventor: Haydon Squires Hucknall, Leicester, United Kingdom

[73] Assignee: ATL Associates Limited, Leicester, United Kingdom

[21] Appl. No.: 09/011,921

[22] PCT Filed: Aug. 23, 1996

[86] PCT No.: PCT/GB96/02051

§ 371 Date: Feb. 23, 1998

§ 102(e) Date: Feb. 23, 1998

[87] PCT Pub. No.: WO97/08667

PCT Pub. Date: Mar. 6, 1997

[30] Foreign Application Priority Data

Aug. 23, 1995 [GB] United Kingdom ..... 9517251

[51] Int. Cl.[6] ..... G07F 11/00

[52] U.S. Cl. ..... 221/6; 221/271

[58] Field of Search ..... 221/6, 4, 5, 8, 221/279, 271; 211/59.3

[56] References Cited

U.S. PATENT DOCUMENTS

| | | | |
|---|---|---|---|
| 2,738,881 | 3/1956 | Michel | 211/49 |
| 5,190,186 | 3/1993 | Yablans et al. | 221/124 |
| 5,199,599 | 4/1993 | Shade | 221/226 |

FOREIGN PATENT DOCUMENTS 2 215 819 8/1974 France .

*Primary Examiner*—Kenneth W. Noland
*Attorney, Agent, or Firm*—Young & Thompson

[57] ABSTRACT

Dispensing apparatus for dispensing individual articles (50) at a dispensing station (A) from a line of the articles stored one-behind-another on a trackway (10) comprises a conveyor belt (16) on which the articles rest. Belt (16) is connected at one end to variable force springs (19) beneath the trackway (10) and at its other end to a follower or pusher plate (13). When the springs (19) are tensioned by moving the plate (13) away from the dispensing station to load the device the conveyor (16) exerts traction on the articles stored thereon tending to move them toward stop means (20,34) at the dispensing station. When an article (51) is removed from the dispensing station (A) the conveyor (16) moves up the remainder so that a next article is positioned at the dispensing station (A) against the stop means (20,34). Ramps (22) at the dispensing station project the article thereat from the dispense to facilitate its removal. In one embodiment the trackway (10) and conveyor (16) are incorporated in a cassette (28) one end wall (34) of which constitutes the stop means. The ramps (22) are positioned opposite a slot (35) in the cassette adjacent this end wall (34) so as to project an article at the dispensing station (A) from the cassette. In another embodiment two conveyor means (16,16A) are provided, articles being located in openings (37) therefore along one of the conveyors (16A) and resting upon the other conveyor (16).

14 Claims, 5 Drawing Sheets

DISPENSER APPARATUS

Figure 1:
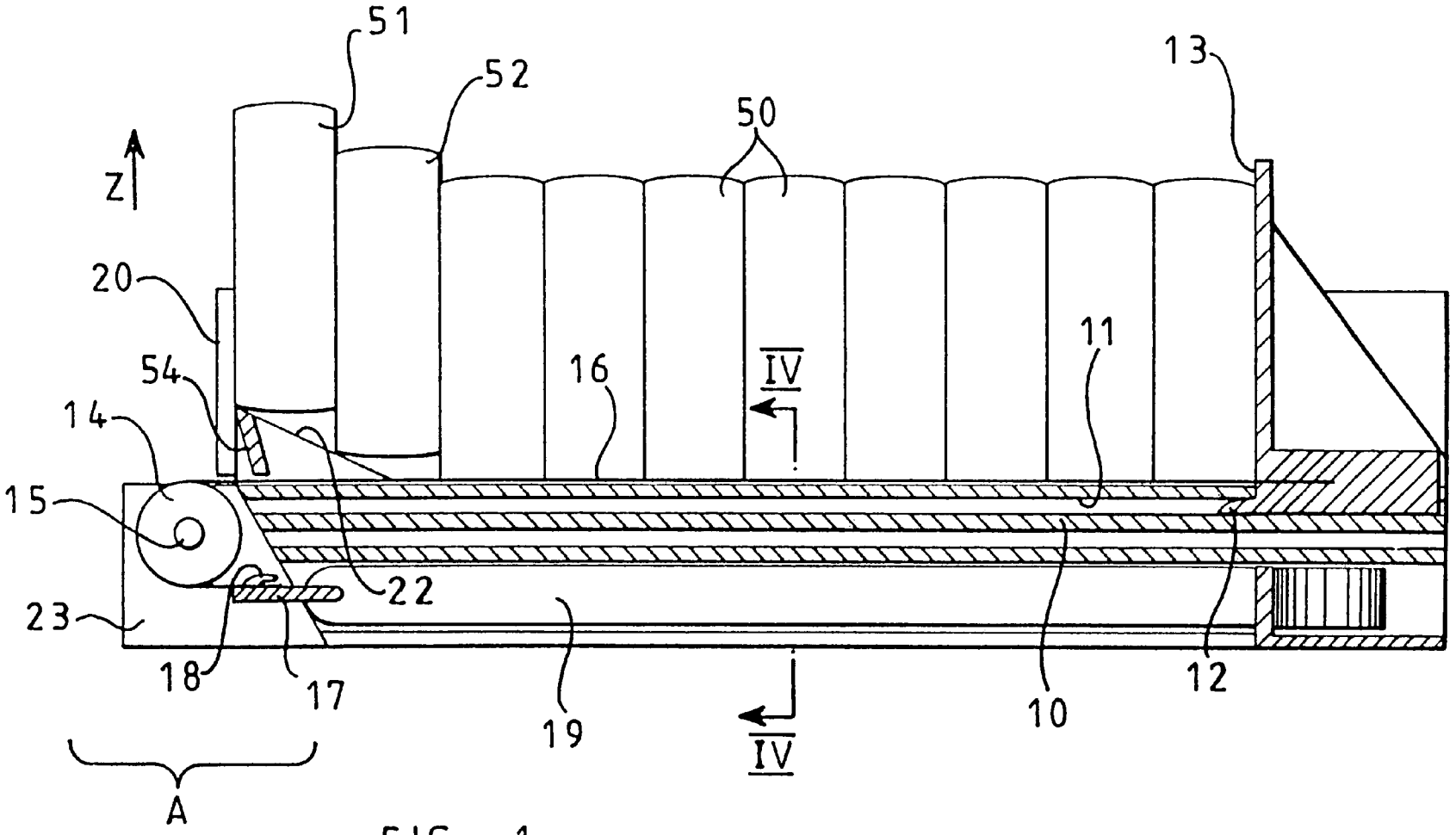

This invention relates to dispenser apparatus for use in retail outlets and the like for vending or dispensing discrete articles, or discretely packaged articles, such as packets of cigarettes or confectionery and other packaged items.

Dispenser apparatus is known whereby packages or articles arranged one-behind-another on a trackway are spring biassed to bring a leading one of the packages to a dispensing station at a leading end of the trackway. When the package at the dispensing station is removed the spring moves up the remaining packages so that a next one becomes accessible at the dispensing station.

U.S. Pat. No. 2,738,881 discloses in FIG. 3 of the Drawings and in the related description an arrangement in which the articles to be dispensed are arranged on a spring-loaded trackway. However a drawback of this and other known dispensers of a similar kind is that there is no way of readily determining, from a position in front of the device, how many articles remain on the trackway. In use the dispenser may be on a shelf at or above eye-level, the trackway extending in the front-to-back direction of the shelf. In this situation the view of articles behind the dispensing station is obstructed by the article at the dispensing station, so that it is not easy to see how many articles remain or indeed whether the article at the dispensing station may be the last one. Shopkeepers will appreciate a way of easily monitoring the state of charge of individual dispensers, to avoid articles being sold from the dispenser running out while in demand. Re-charging of the dispensers is of course best carried out when they are not in use, such as when the shop is closed.

An object of the present invention is to improve upon known dispensing apparatus of this kind.

In accordance with the present invention there is provided apparatus for dispensing discrete articles arranged one-behind-another, the apparatus comprising an elongated, flexible conveyor means having first and second runs which change direction about roller means in the region of said dispensing station, means biassing the second run to tend to draw the first run toward the dispensing station so that, with said articles in contact with said first run, when a leading article is removed from the dispensing station, the remaining articles will be moved incrementally toward the dispensing station, the first run of the conveyor means applying traction to all of said remaining articles, stop means being positioned to arrest said leading article at the dispensing station pending its removal, characterised in that the conveyor means is visible where it changes direction about said roller means from a position on the side of the dispensing station remote from said first run of the conveyor means and in that the conveyor means has indicator means on the surface thereof exposed to view at the dispensing station which indicator means varies along the length of the conveyor means such as to provide at the dispensing station a means of visually monitoring the length of the first run of the conveyor means and thus the number of articles remaining on or in the apparatus after one or more articles have been removed therefrom.

Said indicator means may comprise markings along the length of the conveyor means which are successively revealed as said articles are removed at the dispensing station.

The markings may comprise numbers which have a spacing along the conveyor means generally equal to the thickness of the individual articles, whereby a number visible at the dispensing station indicates the number of articles remaining on the conveyor means.

The indicator means may comprise a marking which diverges across the conveyor means away from the dispensing station such that the width of said marking where exposed at the dispensing station indicates how much of the first run of the conveyor means remains extending from the dispensing station.

The runs of the conveyor means may have distal ends, that of the first run being connected to follower or pusher means upstanding from the conveyor means to be behind the last of the articles thereon and that of the second run being connected to spring means which biasses the conveyor means to tend to move to bring the follower means toward the dispensing station. In this arrangement the follower means may comprise a plate having extending from one edge thereof a formation which engages in a complimentary groove in a trackway thereby to guide the follower means in its movement toward and away from the dispensing station.

Also in this arrangement the second run may be substantially parallel with the first run and its distal end may be connected to a pair of variable force coil springs disposed on the opposite side of the trackway to the follower means with the axes of the coils generally perpendicular to the trackway.

The connection of the distal end of the second run of the conveyor means to the coil springs may be via a connector element having a tab whereby it may be grasped and moved toward the dispensing station to tension the coil springs, the connector element moving in guide means therefor below the trackway which, in the region of the dispensing station, has a latch formation which will retain the connector element in a cocked condition while articles are loaded onto the trackway, thereafter the connector element being releasable from the latch means so that articles on the trackway are biassed toward the dispensing station by the conveyor means.

The latch formation may be constituted by an end of the guide means nearest the dispensing station, the disposition of the guide means relative to the roller means being such that the latter deflects the connector element over said end of the guide means as the connector element reaches the roller means.

There may be provided at the dispensing station ramp means adapted to deflect said leading article out of alignment with the remaining articles as it approaches the stop means, thereby to improve the accessibility of said leading article and to break any adhesion of said leading article to said next article.

There may be associated with the ramp means a mirrored surface at an obtuse angle to the upper run of the conveyor disposed so that the marking exposed when a leading article is lifted from the conveyor by the ramp means can be viewed from a position at or below the level of the trackway.

The trackway may be contained in an elongated cassette of transparent material, the stop means being constituted by the end wall of the cassette at the end region of the cassette which provides the dispensing station and the cassette having a lateral slot at said end region through which said leading article is accessible.

The ramp means may be arranged in the cassette opposite to said slot such that as an article approaches the dispensing station it is projected out of the slot to be partially exposed from the cassette.

The trackway may lie between sidewall means which terminate in the region of the dispensing station in latch elements constituting said stop means.

Figure 2:
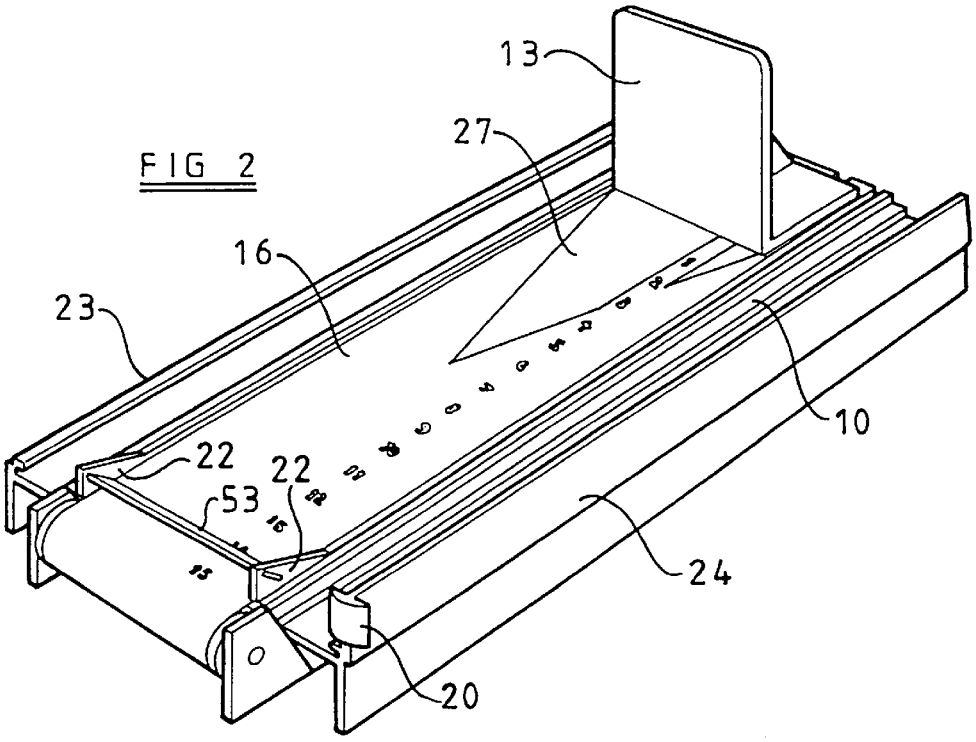
Figure 3:
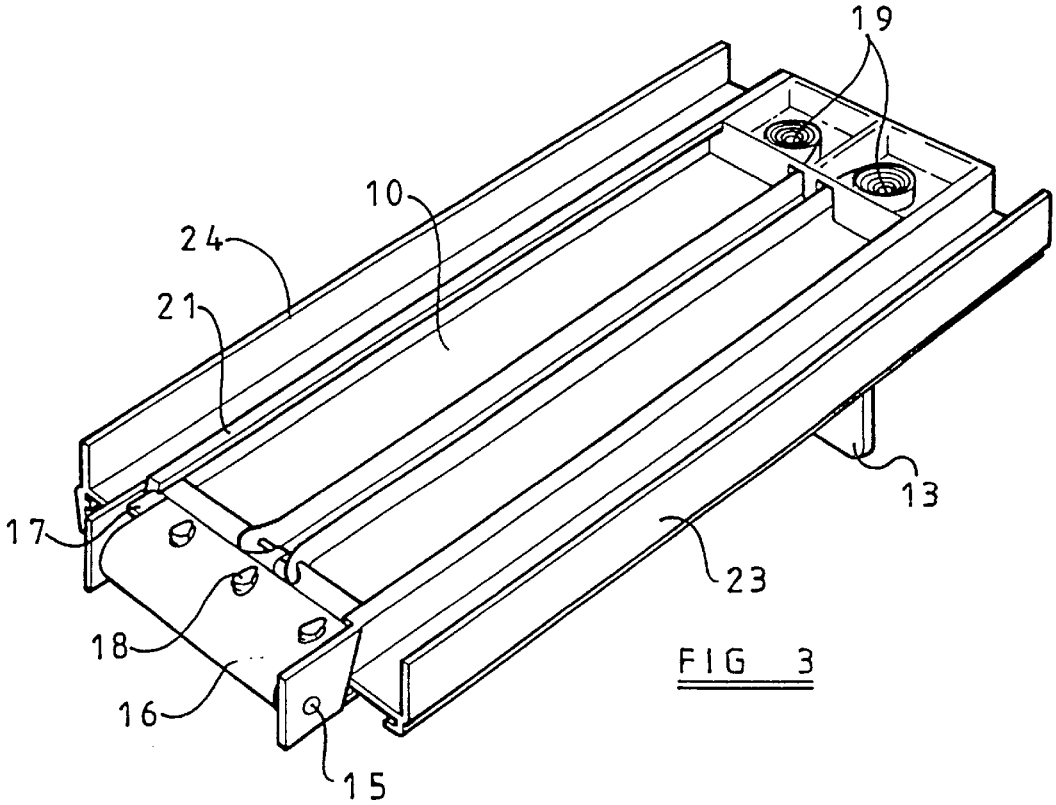
Figure 4A:
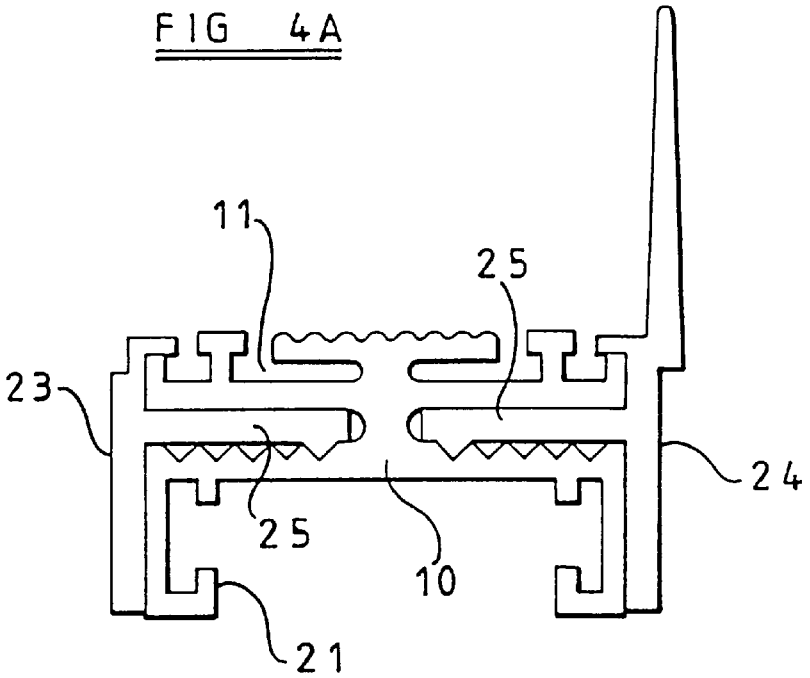
Figure 4B:
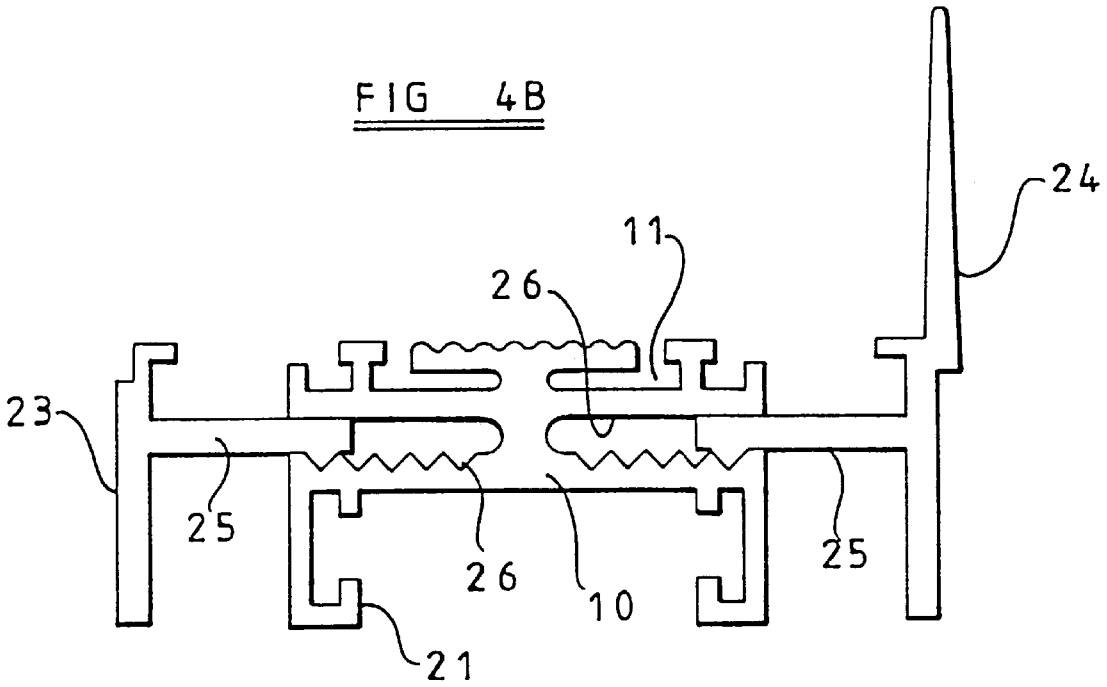
Figure 5:
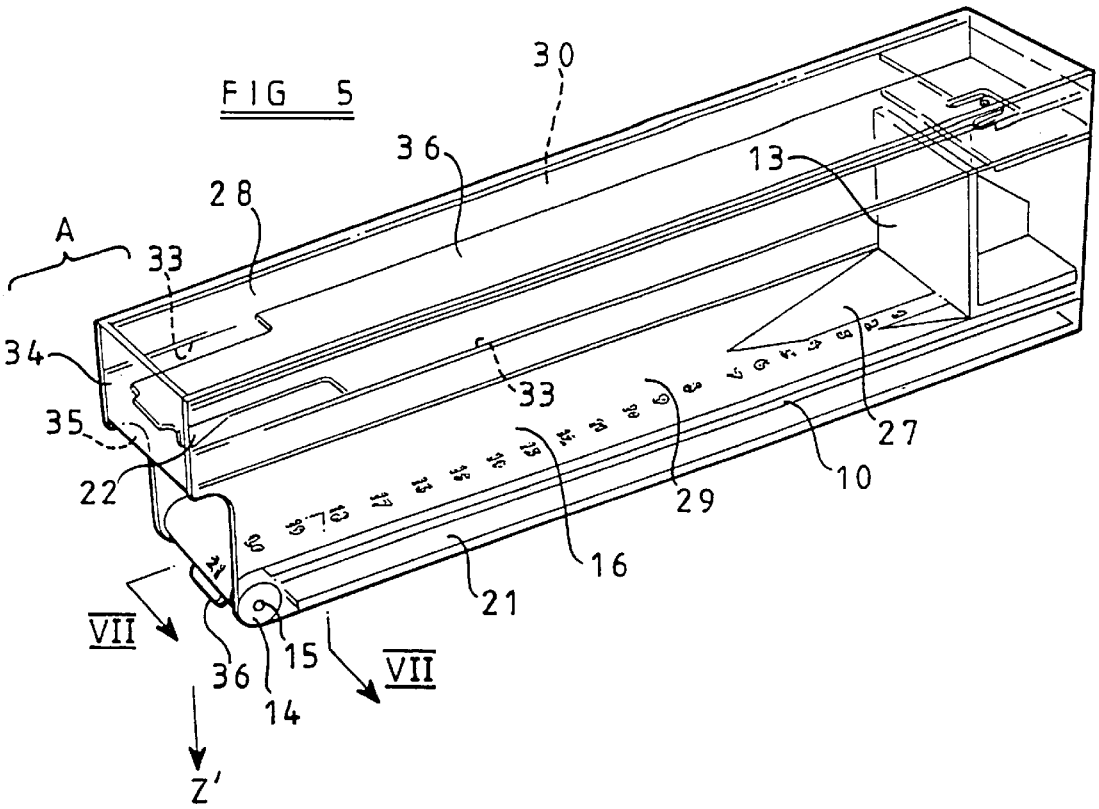
Figure 6:
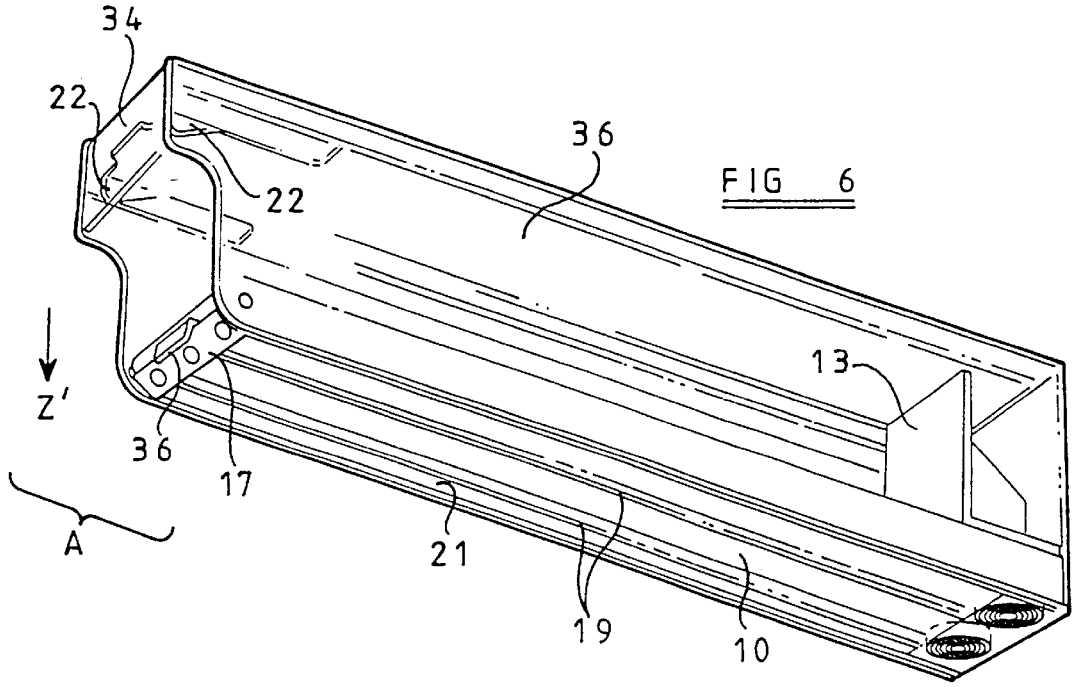
Figure 7:
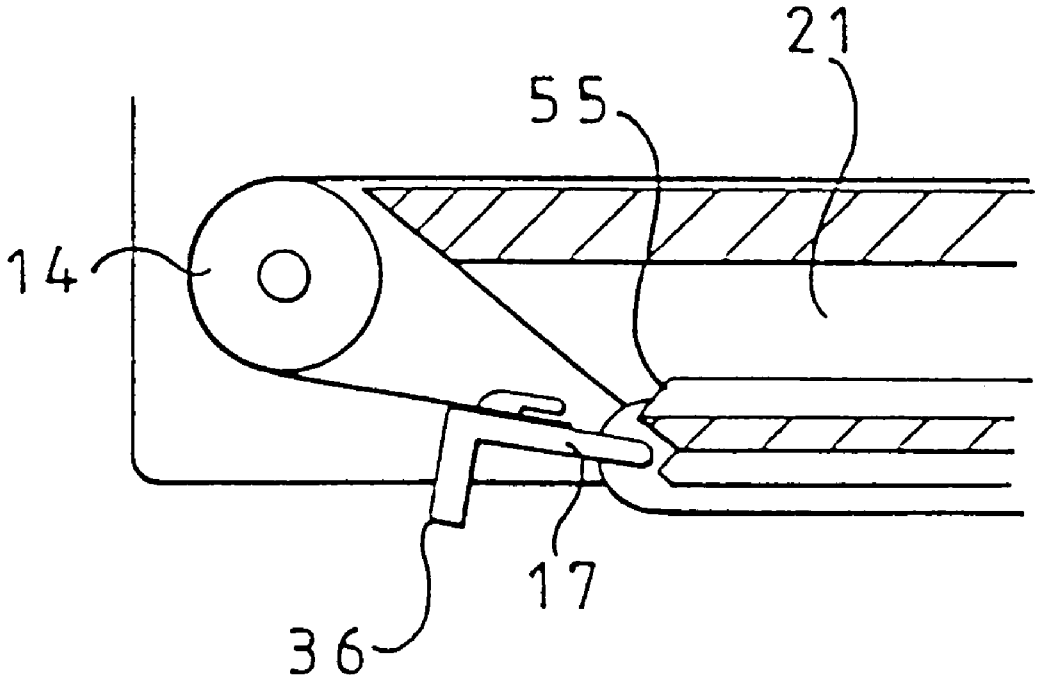

Preferred embodiments of the invention will now be described by way of non-limitative example with reference to the accompanying Drawings, in which:

FIG. 1 is a longitudinal sectional elevation of a first embodiment of dispensing apparatus in accordance with the invention, FIG. 2 is a perspective view from above of the apparatus of FIG. 1 with the end stop removed for clarity, FIG. 3 is a perspective view from below of the dispenser of FIGS. 1 and 2 also with the end stop removed, FIGS. 4A and 4B are sectional views each taken on line IV—IV of FIG. 1 but showing the parts in different positions of adjustment, FIG. 5 is a perspective view from above of a second embodiment of the invention, FIG. 6 is a perspective view from below of the embodiment of FIG. 5, and FIG. 7 is a detail on an enlarged scale taken on the line VII—VII of FIG. 5.

The dispensing apparatus illustrated in FIGS. 1 to 4B inclusive comprises an elongated trackway 10 suitably formed by extruding a plastic material. The upper surface of the trackway 10 is formed with undercut grooves 11 in which feet 12 of a follower means or pusher plate 13 are entrapped so that the plate 13 is slideable along the length of the trackway 10. Adjacent one end of the trackway 10 a roller 14 is mounted on bearings 15 so as to be freely rotatable just in front of the trackway. A flexible belt 16 changes direction about the roller 14 so as to have upper and lower runs on opposite sides of the trackway 10. The distal end of one of these runs is connected to the plate 13 while that of the other is connected by hooks 18 on a connector plate 17 to a pair of variable force coiled springs 19. These are mounted on the underside of the trackway 10 at the end thereof remote from the roller 14. Each is coiled in a plane parallel with that of the trackway 10 for the sake of space economy. The belt 16 may be of a polyester material or any similar rubber-like material, preferably with a surface roughened, textured or even provided with protrusions or pimples to enhance friction. The connector plate 17 travels in a guide channel 21 therefor on the underside of trackway 10.

With the parts positioned as shown in FIGS. 1 and 2, therefore, the springs 19 will tend to draw the plate 13 to the end of the trackway 10 where the roller 14 is located. In use, however, similar packaged articles 50, such as packets of cigarettes, are arranged one-behind-another along the trackway 10 with one edge of each packet in contact with the upper run of the conveyor 16. A leading one 51 of the packages is in contact with stop means 20 adjacent the roller 14. This leading package 51 is at a dispensing station A of the device. As soon as it is removed, by grasping it and pulling it in the direction of arrow Z, the packages 50 remaining on the conveyor 16 are moved up by the springs 19, which displace the conveyor 16 incrementally until a next one 52 of the packages abuts the stop means 20. The plate 13 may have the effect of pushing the rearmost package but this is not regarded as essential or desirable in the functioning of the apparatus. The principal purposes of the plate 13 are to prevent a line of packages toppling backwards and to provide a means of "cocking" the device when it is to be loaded with packages. By grasping the plate 13 and pulling it away from the roller 14 the springs 19 are tensioned and at the same time the upper run of the conveyor 16 is extended to receive a line of packages 50. When the device is charged with the desired number of packages 50 to be dispensed the plate 13 can be released, whereupon the abutment of the leading package 51 against the stop 20 holds the line of packages between the stop 20 and the plate 13.

The region of the end of the trackway 10 where the roller 14 is located thus provides the dispensing station A of the device. Ramp formations 22 on the trackway 10 at the dispensing station are a desirable feature because these displace the leading package 51 in the direction of arrow Z as it approaches the stop means 20 so that it projects slightly out of alignment with the remaining packages 50. This facilitates grasping it and removing it from the device and also breaks any adhesion which may occur between the wrappings of adjacent packages.

Side plate 23 and 24 define with the upper run of the conveyor 16 a channel in which the line of packages 50 will be stored. As shown in FIGS. 4A and 4B each side plate 23 and 24 preferably has a stem 25 engaged in a corresponding groove 26 in the associated side of the trackway 10. As shown the stems 25 are preferably toothed to cooperate with serrations on one side of the associated groove 26. In this way the plates 23 and 24 can be given a mutual spacing appropriate to the widths of the packages to be positioned between them, and the cooperating teeth and serrations will tend to maintain the stems 25 at the chosen position of extension out of the grooves 26.

As seen in FIG. 2, the stop means 20 is provided by a flange on the end of the sidewall 24 nearest the roller 14. A corresponding flange (not shown) is preferably provided on the corresponding end of sidewall 23.

As shown in FIG. 2 the belt 16 is marked along its length with a sequence of numbers commencing adjacent the pusher plate 13. If the mutual spacing of these number is generally equal to the widths of the packages with which the device is loaded the number which becomes visible as the belt passes around the roller 14 when a package has been removed will give a visual indication of how many packages remain to be dispensed. The device of FIGS. 1 to 4B is intended for use on a shelf or counter in such a position that the trackway 10 will extend away from the observer so that it will not always be easy or even possible to see more than the package currently at the dispensing station.

As an alternative or addition to the numbers the end region of the belt 16 nearest to the plate 13 may have a diverging marking 27 preferably of a bright colour such as red. The width of this marking 27 visible at the dispensing station will give a visual indication of how much of the length of the belt 16 remains to be drawn to the dispensing station and thus provides at least a warning that the device is about to run out of goods to be dispensed.

A plate 53 extends between the ramps 22 and has a mirrored surface 54 presented outwardly and downwardly at an obtuse angle relative to the upper run of the conveyor 16. By means of mirror 54 the marking (the number "15" as seen in FIG. 2) which is exposed at the dispensing station when the corresponding packet 51 has been lifted from the conveyor 16 by the ramps 22 can be viewed from a position below the device. If the device is on a shelf or counter at or above eye level this enables the state of charge of the device to be monitored without lifting it down to see how many packages remain in it.

The embodiment of the invention illustrated in FIGS. 5, 6 and 7 is essentially similar to that of FIGS. 1–4B, and like parts are identified by like reference numerals, except that in this embodiment the trackway 10 and the components mounted on it as well as the roller 14 are encased in a cassette 28 of transparent plastics material. Sidewalls 29 and 30 of the cassette replace the function of the side plates 23 and 24 of the previously described embodiment. Moreover the ramps 22 are provided not on the trackway 10 but at one end of a cover member 36 which can be slid into the cassette 28 along guides 33 therefor at a height above the upper run of the belt 16 appropriate to the height of packaging with which the cassette is charged.

The function of the stop means 20 of the preceding embodiment is performed by one of the end walls 34 of the cassette. This is adjacent a cut-away part of the cassette defining a downwardly-opening slot 35 adjacent the roller 14. A leading package moved along the cassette by the belt 16 is therefore deflected by the ramps 22 to project downwardly out of the slot 35 where it can be grasped and removed from the cassette in the direction Z'.

To charge the cassette 28 with packages, for example packets of cigarettes arranged one-behind-another along the upper run of the belt 16, first of all and while the cassette is empty the springs 19 are tensioned by grasping a tab 36 projecting from the connector plate 17 and drawing the connector plate 17 along the guide channel 21 until it emerges from the end 55 thereof nearest the roller 14. At this point (see FIG. 7) the connector plate 17 is deflected downward because of the diameter of the roller 14 so that it lodges against the end 55 of guide channel 21, holding the springs 19 fully extended. Preferably and as shown the end 55 is formed with a notch to engage plate 17. The cassette is now loaded with packages to be dispensed, following which the connector plate 17 is manipulated by the tab 36 until it re-enters the guide channel 21, enabling the springs 19 to move the belt 16 until a leading one of the packages is presented by the ramps 22 out of the slot 35.

The belt 16 need not be horizontal. The cassette of the embodiment of FIGS. 5 and 6 may be disposed in any desired attitude with the slot 35 presenting the leading package in any desired direction Z'.

I claim:

1. Apparatus for dispensing discrete articles (50) arranged one-behind-another, the apparatus comprising an elongated, flexible conveyor means (16) having first and second runs which change direction about roller means (14) in the region of said dispensing station (A), means (19) biassing the second run to tend to draw the first run toward the dispensing station (A) so that, with said articles in contact with said first run, when a leading article (51) is removed from the dispensing station (A), the remaining articles (50) will be moved incrementally toward the dispensing station (A), the first run of the conveyor means applying traction to all of said remaining articles (50), stop means (20,34) being positioned to arrest said leading article (51) at the dispensing station (A) pending its removal, characterised in that the conveyor means (16) is visible where it changes direction about said roller means (14) from a position on the side of the dispensing station (A) remote from said first run of the conveyor means (16) and in that the conveyor means (16) has indicator means (27) on the surface thereof exposed to view at the dispensing station (A) which indicator means (27) varies along the length of the conveyor means (16) such as to provide at the dispensing station (A) a means (27) of visually monitoring the length of the first run of the conveyor means (16) and thus the number of articles remaining on or in the apparatus after one or more articles (50) have been removed therefrom.

2. Apparatus as claimed in claim 1, characterised in that said indicator means (27) comprises markings along the length of the conveyor means (16) which are successively revealed as said articles (50) are removed at the dispensing station (A).

3. Apparatus as claimed in claim 2, characterised in that the markings comprise numbers which have a spacing along the conveyor means (16) generally equal to the thickness of the individual articles, whereby a number visible at the dispensing station (A) indicates the number of articles (50) remaining on the conveyor means (16).

4. Apparatus as claimed in claim 1, characterised in that the indicator means comprises a marking (27) which diverges across the conveyor means (16) away from the dispensing station (A) such that the width of said marking (27) where exposed at the dispensing station (A) indicates how much of the first run of the conveyor means (16) remains extending from the dispensing station (A).

5. Apparatus as claimed in claim 1, characterised in that the runs of the conveyor means (16) have distal ends, that of the first run being connected to follower or pusher means (13) upstanding from the conveyor means (16) to be behind the last of the articles (50) thereon and that of the second run being connected to spring means (19) which biasses the conveyor means (16) to tend to move to bring the follower means (13) toward the dispensing station (A).

6. Apparatus as claimed in claim 5, characterised in that the follower means comprises a plate (13) having extending from one edge thereof a formation (12) which engages in a complimentary groove (11) in a trackway (10) thereby to guide the follower means (13) in its movement toward and away from the dispensing station (A).

7. Apparatus as claimed in claim 6, characterised in that the second run is substantially parallel with the first run and its distal end is connected to a pair of variable force coil springs (19) disposed on the opposite side of the trackway (10) to the follower means (13) with the axes of the coils generally perpendicular to the trackway (10).

8. Apparatus as claimed in claim 7, characterised in that the connection of the distal end of the second run of the conveyor means (16) to the coil springs (19) is via a connector element (17) having a tab (36) whereby it may be grasped and moved toward the dispensing station (A) to tension the coil springs (19), the connector element (17) moving in guide means (21) therefor below the trackway (10) which, in the region of the dispensing station (A), has a latch formation (55) which will retain the connector element (17) in a cocked condition while articles (50) are loaded onto the trackway (10), thereafter the connector element (17) being releasable from the latch means (55) so that articles on the trackway are biassed toward the dispensing station (A) by the conveyor means (16).

9. Apparatus as claimed in claim 8, characterised in that the latch formation is constituted by an end (55) of the guide means (21) nearest the dispensing station (A), the disposition of the guide means (21) relative to the roller means (14) being such that the latter deflects the connector element (17) over said end of the guide means (21) as the connector element (17) reaches the roller means (14).

10. Apparatus as claimed in claim 1, characterised in that there is provided at the dispensing station (A) ramp means (22) adapted to deflect said leading article (51) out of alignment with the remaining articles (50) as it approaches the stop means (20,34), thereby to improve the accessibility of said leading article (51) and to break any adhesion of said leading article (51) to said next article (52).

11. Apparatus as claimed in claim 10, characterised in that there is associated with the ramp means (22) a mirrored surface (54) at an obtuse angle to the upper run of the conveyor (16) disposed so that the marking exposed when a leading article (51) is lifted from the conveyor (16) by the ramp means (22) can be viewed from a position at or below the level of the trackway (10).

12. Apparatus as claimed in claim 1, characterised in that the trackway (10) is contained in an elongated cassette (28) of transparent material, the stop means (34) being constituted by the end wall of the cassette (28) at the end region of the cassette which provides the dispensing station (A) and the cassette (28) having a lateral slot (35) at said end region through which said leading article is accessible.

13. Apparatus as claimed in claim 12, characterised in that the ramp means (22) is arranged in the cassette (28) opposite to said slot (35) such that as an article (51) approaches the dispensing station (A) it is projected out of the slot (35) to be partially exposed from the cassette (28).

14. Apparatus as claimed in claim 13, characterised in that the trackway (10) lies between sidewall means (23,24) which terminate in the region of the dispensing station (A) in latch elements (20) constituting said stop means.

* * * * *